US007060882B2

(12) United States Patent
Greenwald

(10) Patent No.: US 7,060,882 B2
(45) Date of Patent: Jun. 13, 2006

(54) MULTI-CONTACT PICK AND METHOD OF CONVERTING A STANDARD PICK INTO A MULTI-CONTACT PICK

(76) Inventor: Ken Greenwald, 82 Canterbury Rd., White Plains, NY (US) 10607

( * ) Notice: Subject to any disclaimer, the term of this patent is extended or adjusted under 35 U.S.C. 154(b) by 19 days.

(21) Appl. No.: 10/819,811

(22) Filed: Apr. 7, 2004

(65) Prior Publication Data

US 2005/0223872 A1 Oct. 13, 2005

(51) Int. Cl.
*G10D 3/16* (2006.01)

(52) U.S. Cl. ..... 84/320

(58) Field of Classification Search ..... 84/315–322
See application file for complete search history.

(56) References Cited

U.S. PATENT DOCUMENTS 2,484,820 A * 10/1949 Galetzky ..... 84/322
4,398,444 A * 8/1983 Walker ..... 84/322
D317,617 S * 6/1991 Mutti ..... D17/20

* cited by examiner

*Primary Examiner*—Kimberly Lockett
(74) *Attorney, Agent, or Firm*—Lackenbach Siegal, LLP

(57) ABSTRACT

The present invention is a multi-contact pick for either stunning or articulated picking of a stringed musical instrument. The pick is formed with one or more cuts in close proximity to the apex of the pick contact. The cuts are formed in the pick such that the contacts resulting are slightly fanned across the thickness. Optionally, a stress relief hole may also be formed at the end of each cut to increase the life of the pick. The pick may come in many shapes and configurations. For example, a multi-lobed pick may have a standard single contact for one lobe and a cut multi-contact array for a second lobe.

20 Claims, 7 Drawing Sheets

MULTI-CONTACT PICK AND METHOD OF CONVERTING A STANDARD PICK INTO A MULTI-CONTACT PICK

FIELD OF THE INVENTION

The present invention relates to plectrums, also known as picks; used for pluking a stringed musical instrument. More specifically, the present invention relates to plectrums having multiple contact points arranged to interact with the string in rapid succession during a single pluking action.

BACKGROUND

Picks are used to pluck the strings on stringed musical instruments such as those of the lute family. Referring to FIGS. 1*a–c*, commonly found standard picks come in a variety of shapes as well as varying configurations of thickness, size, and material (See FIG. 1*a* illustrating a common teardrop shape, FIG. 1*b* illustrating a triangle shape, and FIG. 1*c* illustrating a curved triangle shape.) When a string is plucked with one of these picks a single contact point interacts with the string causing the string to vibrate thereby producing a tone.

A significant number of attempts have been made to produce a pick that has multiple contact points that interact with the string in rapid succession as the result of a single pluck. One approach has been to sandwich two or more picks together with or without a spacer between each pair. FIGS. 1*d* and 1*e* are examples of such multi-contact picks using this approach. Also, U.S. Pat. Nos. 768,241; 2,221,234; 3,304,826; 3,312,137; 3,678,793; 4,226,160; 4,248,128; 4,398,444; 4,651,614; 4,790,227; 5,252,562; 5,594,189; Des 358,833; and Des 369,615, each the entirety of which is herein incorporated by reference, are all directed to such sandwiched array type multipoint picks.

Another approach has been to construct a multi-point pick of a unitary layer wherein the shape configures multiple points laterally along an edge in saw-tooth fashion. This category includes those picks that have one or more serrated edges. U.S. Pat. Nos. 2,459,275; 2,481,759; 2,484,820; 4,993,301; Des 317,617; Des 395,330, each the entirety of which is herein incorporated by reference, are all directed to such saw-tooth type multipoint picks.

Other approaches are also known. U.S. Pat. No. 5,942,704, the entirety of which is herein incorporated by reference, is directed to a plurality of resilient brush bristles arranged in brush like manner and mounted on the tip of the pick U.S. Pat. No. 5,942,704, the entirety of which is herein incorporated by reference, is directed to a plurality of finger members of equal length directed radially outward along an upper edge (See FIG. 1*f*). U.S. Pat. No. 6,133,516, the entirety of which is herein incorporated by reference, is directed to a pick constructed of a plurality of narrow elongated pick members embedded in a finger grip (See FIG. 1*h*). U.S. Pat. No. 6,245,977 B1, the entirety of which is herein incorporated by reference, is directed to a pick having a pair of contact points, one nested within the other, the inner resulting from a slit along the perimeter of the outer (See FIG. 1*g*).

In general, the prior art multipoint picks either have only two effective contact points or are excessively bulky, especially the sandwiched array type multipoints. This is because, each additional point is the consequence of adding another whole pick and spacer to the array. The bulkiness increases the difficulty plucking a single string without touching an adjacent string. Consequently, the prior art multi-contact type of picks are known to be useful only for strumming the instrument but not for "picking".

OBJECTS AND SUMMARY OF THE INVENTION

It is an object of the present invention to overcome the problems of the prior art. It is another object of the present invention to provide a multi-contact pick, including; at least one lobe having an apex; at least one cut in the lobe; each cut being one of on the apex and in proximity to the apex such that the number of the multi-contacts formed on the lobe is equal to one more than the number of the cuts; the lobe having a thickness; and the multi-contacts fanning across the thickness.

It is another object of the present invention to provide a multi-contact pick, including; at least one lobe having an apex; at least one cut in the lobe; each cut being one of on the apex and in proximity to the apex such that the number of the multi-contacts formed on the lobe is equal to one more than the number of the cuts; the lobe having a thickness; the multi-contacts fanning across the thickness the cuts are one of parallel and convergent toward the apex; the cuts are one of smooth and serrated; the cuts are one of straight and curved; the cuts are one of evenly spaced across the apex and randomly spaced across the apex; the cuts are one of variable length and equal length; and the number of the cuts are one of laterally symmetrical across the apex and laterally asymmetrical across the apex.

It is another object of the present invention to provide a multi-contact pick, including; at least one lobe having an apex; at least one cut in the lobe; each cut being one of on the apex and in proximity to the apex such that the number of the multi-contacts formed on the lobe is equal to one more than the number of the cuts; the lobe having a thickness; the multi-contacts farming across the thickness; and each cut has a stress relief hole located at the end of the cut.

It is another object of the present invention to provide a multi-contact pick, including; at least one lobe having an apex; at least one cut in the lobe; each cut being one of on the apex and in proximity to the apex such that the number of the multi-contacts formed on the lobe is equal to one more than the number of the cuts; the lobe having a thickness; the multi-contacts fanning across the thickness; and a pivot hole in the pick at the pick's geometric center.

It is another object of the present invention to provide a method of converting a single contact pick into a multi-contact pick, including the step of making at least one cut in a lobe of the single contact pick at a position that is one of on an apex of the lobe and in proximity to the apex such that the number of the multi-contacts formed on the lobe is equal to one more than the number of the cuts.

It is another object of the present invention to provide a method of converting a single contact pick into a multi-contact pick, including the step of making at least one cut in a lobe of the single contact pick at a position that is one of on an apex of the lobe and in proximity to the apex such that the number of the multi-contacts formed on the lobe is equal to one more than the number of the cuts; the cuts are one of parallel and convergent toward the apex; the cuts are one of smooth and serrated; the cuts are one of straight and curved; the cuts are one of evenly spaced across the apex and randomly spaced across the apex; the cuts are one of variable length and equal length; and the number of the cuts are one of laterally symmetrical across the apex and laterally asymmetrical across the apex.

It is another object of the present invention to provide a method of converting a single contact pick into a multi-contact pick, including the step of making at least one cut in a lobe of the single contact pick at a position that is one of on an apex of the lobe and in proximity to the apex such that the number of the multi contacts formed on the lobe is equal to one more than the number of the cuts; and further including the step of forming a stress relief hole at the end of each cut.

It is another object of the present invention to provide a method of converting a single contact pick into a multi-contact pick, including the step of making at least one cut in a lobe of the single contact pick at a position that is one of on an apex of the lobe and in proximity to the apex such that the number of the multi-contacts formed on the lobe is equal to one more than the number of the cuts; and further including the step of forming a pivot hole at the geometric center of the pick.

Briefly stated the present invention is a multi-contact pick for either strumming or articulated picking of a musical instrument. The pick is formed with one or more cuts in close proximity to the apex of the pick contact. The cuts are formed in the pick such that the contacts resulting are slightly fanned across the thickness. Optionally, a stress relief hole may also be formed at the end of each cut to increase the life of the pick. The pick may come in many shapes and configurations. For example, multi-lobed pick may have a standard single contact for one lobe and a multi-contact for a second lobe.

The above, and other objects, features and advantages of the present invention becomes apparent in the following description and accompanying drawings, in which like reference numerals designate the same elements.

DETAILED DESCRIPTION OF THE PREFERRED EMBODIMENT(S)

Figure 1A:
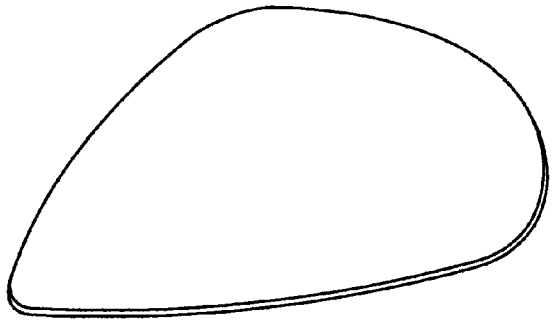
Fig 1a Prior Art
FIGS. 1*a–c* are perspective views of single contact picks of the prior art.
Figure 1B:
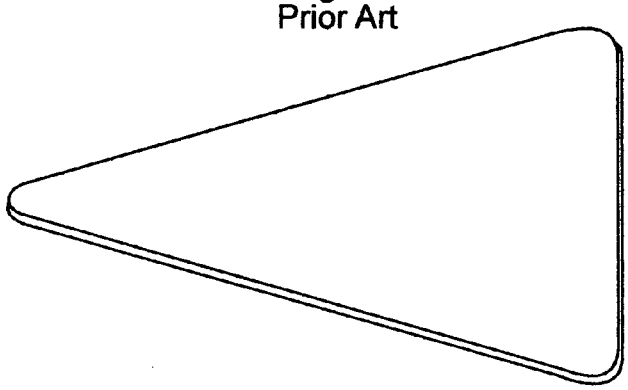
Fig 1b Prior Art
Figure 1C:
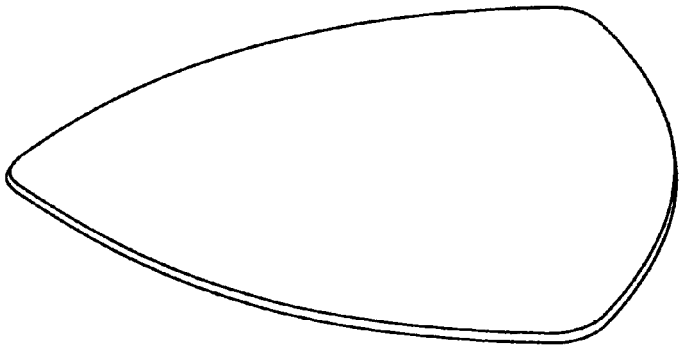
Fig 1c Prior Art
Figure 1D:
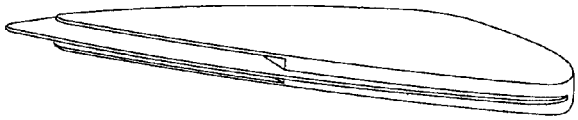
Fig 1d Prior Art
FIGS. 1*d–h* are perspective views of multi-contact picks of the prior art.
Figure 1E:
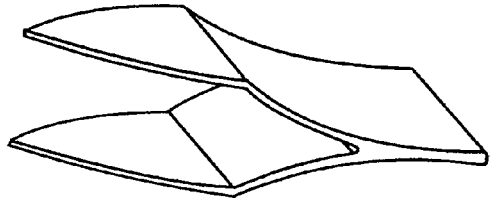
Fig 1e Prior Art
Figure 1F:
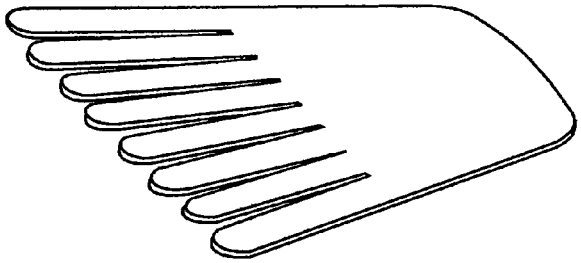
Fig 1f Prior Art
Figure 1G:
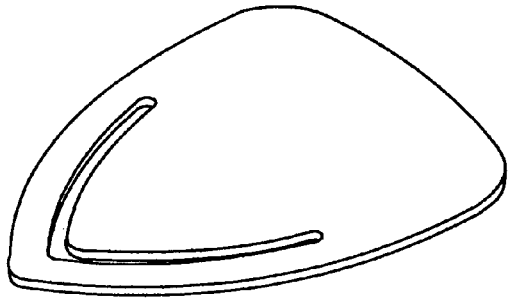
Fig 1g Prior Art
Figure 1H:
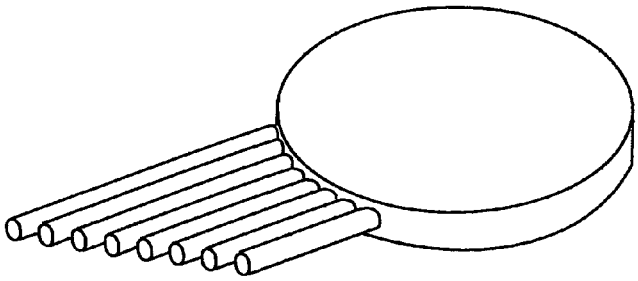
Fig 1h Prior Art
Figure 2A:
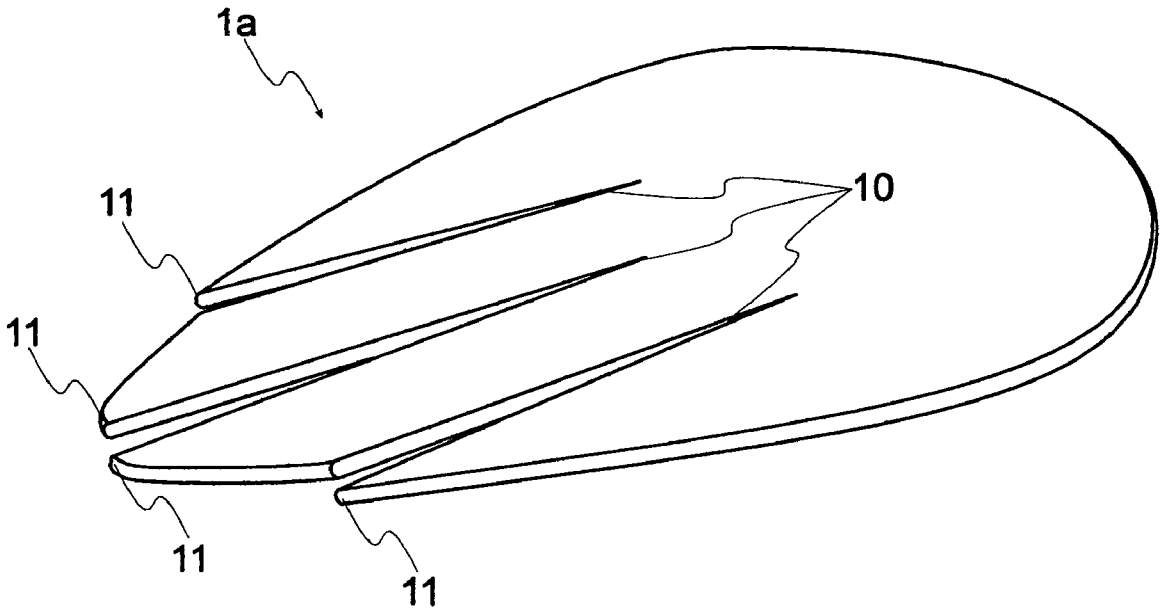
FIGS. 2*a–c* are perspective views of single-lobed teardrop shaped multi-contact picks of the present invention.

The present invention has taken the approach of cutting a contact on a single contact pick such that the single contact is divided into multiple contacts concentrated within the space of the single contact. It is intended that when the cuts are made, for example, using a shearing or punching process, the material at the edges and ends of the cut is stretched resulting in a slight fanning of the contacts across the thickness of the pick. This fanning effect is clearly seen in FIG. 2*a*, where three parallel shearing cuts 10 divide the single contact of a FIG. 1*a* standard teardrop shaped pick into four contacts 11 creating a fan pick la of the present invention. Also in FIG. 2*b*, five parallel shearing cuts 10 divide the single contact of a FIG. 1*a* standard teardrop shaped pick into six contacts 11 creating a fan pick 1*b* of the present invention.

Figure 2B:
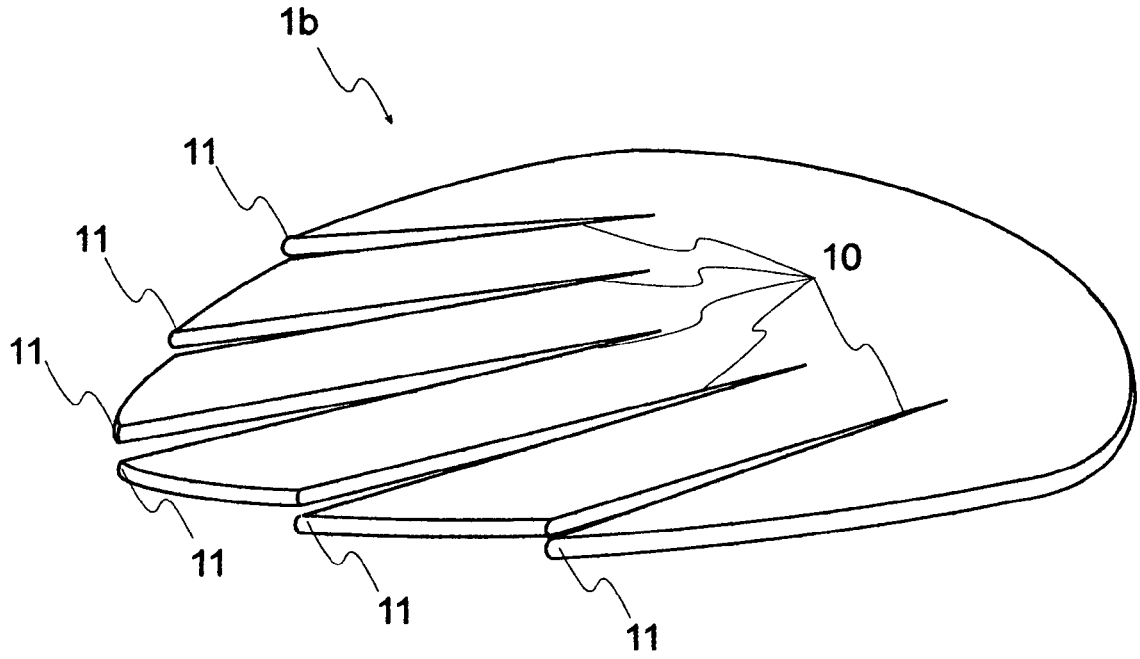
Figure 2C:
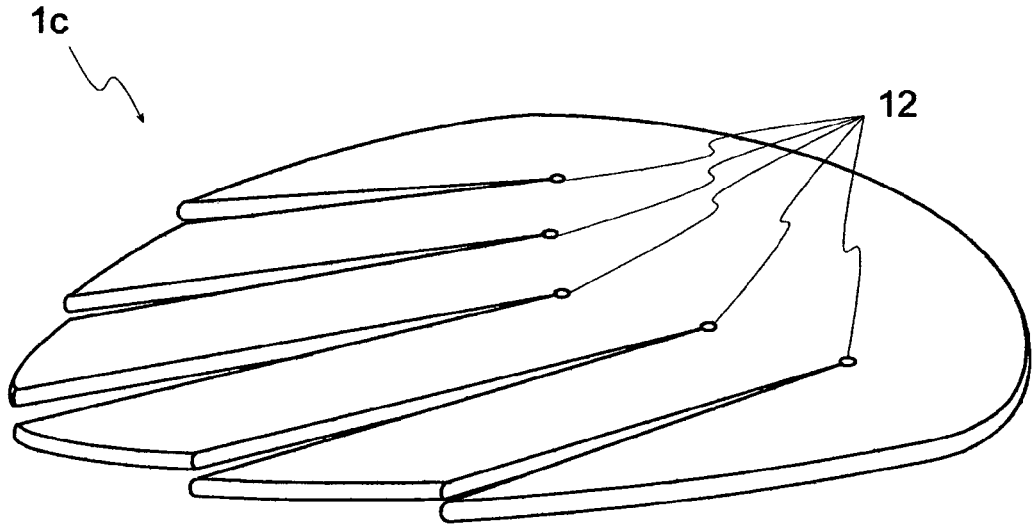

Referring to FIG. 2*c*, optionally the fan pick of FIG. 2*b* is further improved by a stress relief hole 12 at the end of each cut 10. Stress relief holes 12 provide stability to the material thereby increasing the useful life of the pick Without these stress relief holes 12, the back and forth bending of the contacts during rigorous play will eventually result in one or more of the contacts breaking off; the fracture point being initiated at the end of a shearing cut 10 where the pick material was stressed during the cut. The presence of the stress relief holes 12 at the end of the cut eliminates the most stressed material thereby removing the fracture initiation point.

A number of manufacturing methodologies are suitable for producing picks of the present invention including shearing, slicing, punching, stamping, molding, casting etc. Regardless of the methodology, the cut lines must be produced such as to cause the slight lateral fanning demonstrated in FIGS. 2*a–c*. It is anticipated that this fanning effect can be achieved not only by shearing existing commercially available picks along the cut lines, but also, for example: by injection molding or casting into an appropriately shaped mold, or by punching or stamping with an appropriately configured punch and die.

Figure 3A:
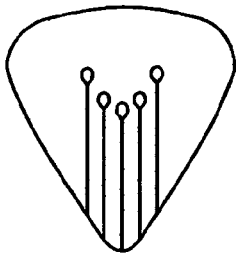
FIGS. 3*a–r* are plan views of single-lobed teardrop shaped multi-contact picks of the present invention illustrating the variety and range of cut configurations.
Figure 3B:
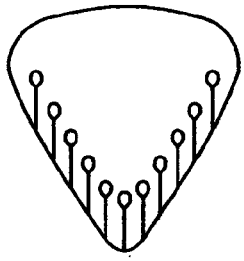
Figure 3C:
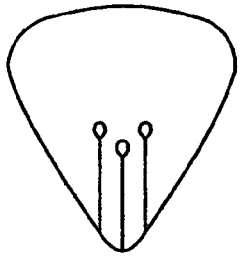
Figure 3D:
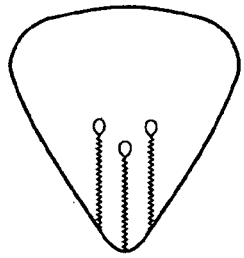

A range of cut configurations is anticipated. For example, referring to FIGS. 3*a–r*, a teardrop shaped pick having cuts 10 forming a fan pick 1 may range as comparatively: long or short; smooth or serrated; parallel or angled; straight or curved; evenly spaced or randomly spaced, of equal or unequal length; numerous or only one; symmetrically disposed of laterally skewed; etc. As shown here, FIG. 3*a* has five relatively long cuts made deeply into the contact close to the apex while FIG. 3*b* illustrates eleven relatively short cuts made shallowly along the lateral periphery of the contact. FIG. 3*c* illustrates a three cut pick where the cuts are made with smooth bladed shears. Whereas, FIG. 3*d* illustrates a three cut pick where the cuts are made with serrated shears thereby producing a rough serrated edge on the cut.

Figure 3E:
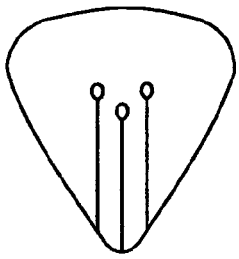
Figure 3F:
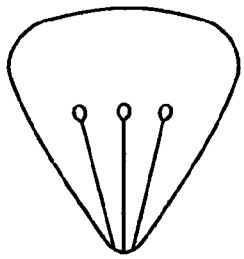
Figure 3G:
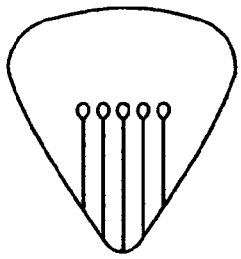
Figure 3H:
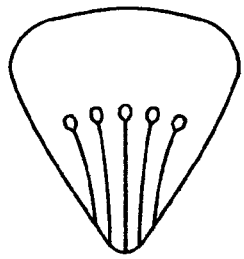
Figure 3I:
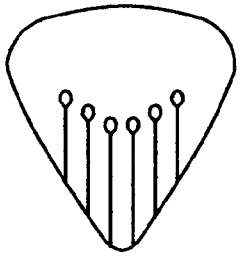
Figure 3J:
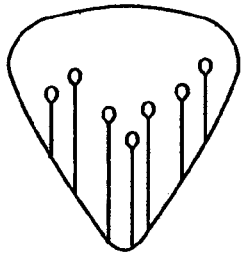
Figure 3K:
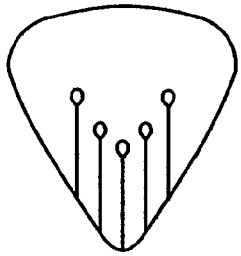
Figure 3L:
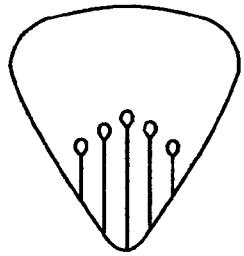
Figure 3M:
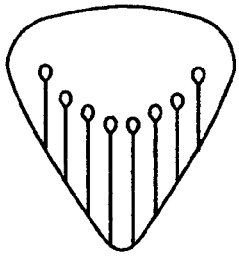
Figure 3N:
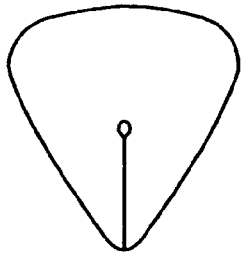
Figure 3O:
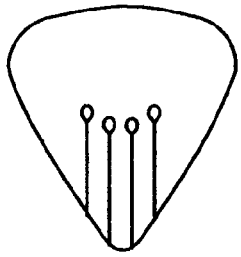
Figure 3P:
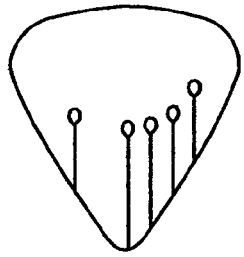
Figure 3Q:
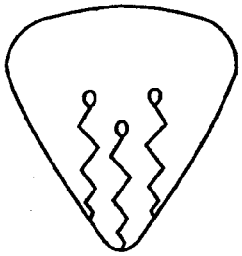
Figure 3R:
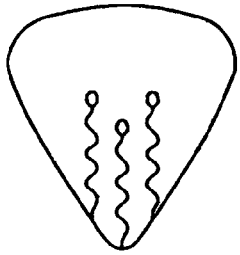
Figure 4A:
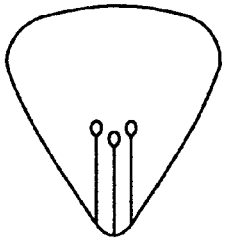
FIGS. 4*a–m* are plan views of multi-contact picks of the present invention exemplifying the variety and range of shape configurations.
Figure 4B:
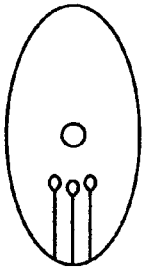
Figure 4C:
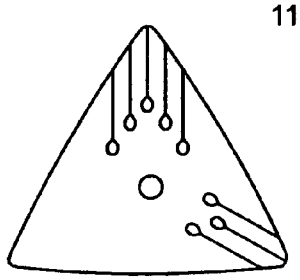
Figure 4D:
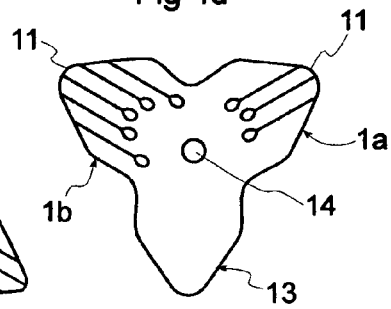

FIG. 3*e* illustrates a three cut pick where the cuts are essentially parallel to one another, while in FIG. 3*f* the cuts are divergent. Similarly, FIG. 3*g* illustrates a five cut pick where the cuts are parallel and straight; while in FIG. 3*h* the cuts begin parallel then curve and diverge. In FIG. 3*i* the cuts are parallel and evenly spaced laterally whereas the FIG. 3*j* cuts, while parallel, are randomly spaced laterally. FIG. 3*k* exemplifies a pick where all the cuts are of the same length. Whereas, FIG. 3*l* shows a pick where the cuts are of decreasing length laterally from the apex cut. FIG. 3*m*, an eight cut pick, is an example of a pick with many cuts, while FIG. 3*n* is an example of a one cut pick. FIG. 3*o* illustrates a pick where the number of cuts are laterally symmetrical across the apex line and FIG. 3*p* shows a laterally asymmetrical pick where the number of cuts to the right of the apex line is different than the number to the left. Lastly, FIG. 3*q* illustrates a three cut pick with the cut lines being in a zigzag pattern, and FIG. 3*r* illustrates a three cut pick with the cut lines being in a wavy pattern Picks of the present invention are also anticipated in a plethora of sizes, shapes, and configurations. Referring to FIG. 4*d*, for example, the modified triangle presents three apex positions from which a contact can be used as a pick. Modifying one or more of those apex contacts according to the present invention results in a three position pick that has a conventional contact 13 on one apex, a fan pick 1*a* with four contacts 11 at a second apex, and a fan pick 1*b* with six contacts 11 at a tired apex. Accordingly, a musician can change picks "on the fly" by simply turning the pick to expose the desired apex position. Toward this end a centrally disposed pivot hole 14 is optionally provided.

Figure 4E:
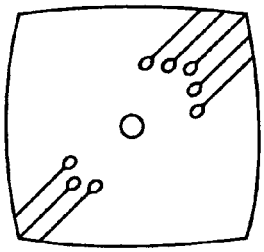
Figure 4F:
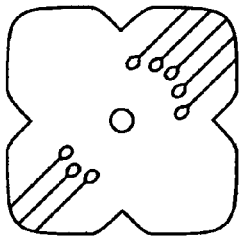
Figure 4G:
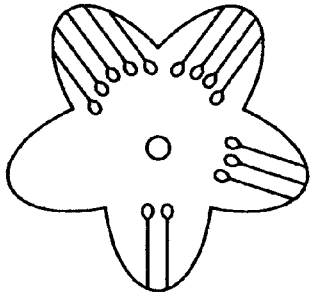

Referring to FIGS. 4*a–m*, numerous other examples are shown. FIG. 4*a* is a three cut teardrop shaped pick. FIG. 4*b* is an oval shaped pick with one end cut into a three cut fan pick and the other end left uncut. A pivot hole is also shown. FIG. 4*c* is a curved triangle pick where a first apex is left uncut, a second apex is cut into a 3 cut fan pick, and a third apex is cut into a 5 cut fan pick. FIGS. 4*e* and 4*f* are four lobed shapes wherein 2 apexes are left uncut while 2 other apexes are cut into three and five cut fan picks respectively. FIG. 4*g* is a five lobed shape with a first uncut apex a second apex cut into a two cut fan pick, a third apex cut into a three cut fan pick, a fourth apex cut into a four cut fan pick, and a fifth apex cut into a five cut fan pick.

Figure 4H:
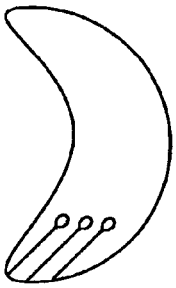
Figure 4I:
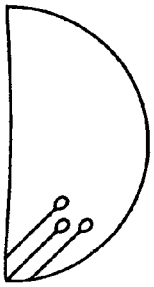
Figure 4J:
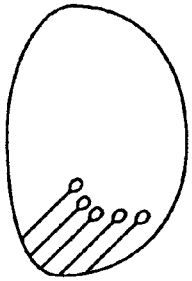
Figure 4K:
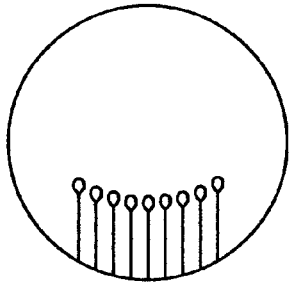
Figure 4L:
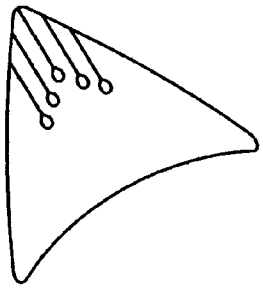
Figure 4M:
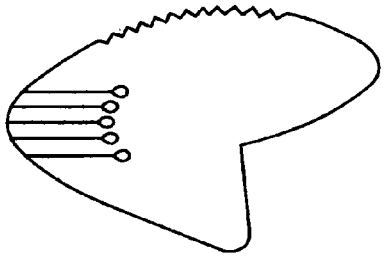

FIG. 4H is a quarter moon shaped pick with one end cut into a three cut fan pick. FIG. 48*i* is a half moon shaped pick with one end cut into a three cut fan pick. FIG 4*j* is a three quarter moon shaped pick with one end cut into a five cut fan pick. FIG. 4*k* is a full moon shaped pick with one end cut into a nine cut fan pick. FIG. 4*l* illustrates a free form three lobed pick with one lobe cut into a five cut fan pick and the remaining lobes being uncut. FIG. 4*m* illustrates another free form three lobed pick with one lobe cut into a five cut fan pick and the remaining lobes being uncut. Also featured in the FIG. 4*m* pick is an optional serrated edge.

Figure 5A:
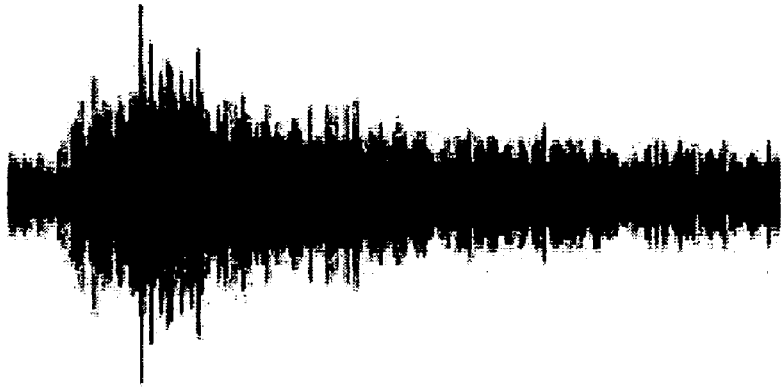
FIGS. 5*a–c* are wave form tracings from a plucked guitar string.
Figure 5B:
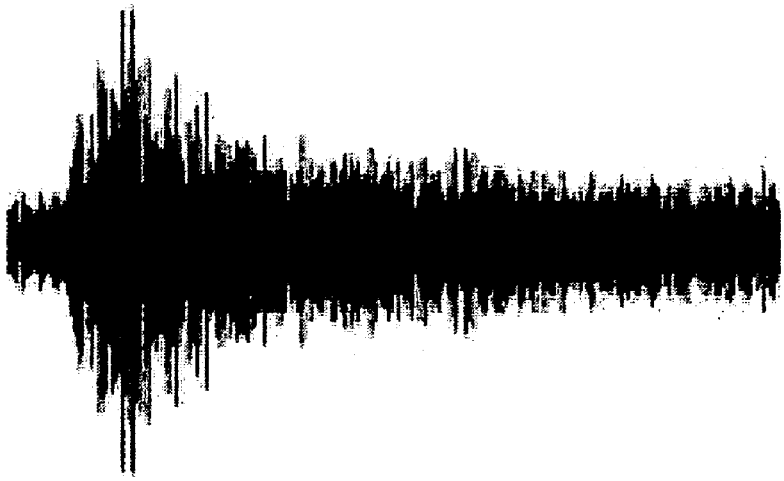
Figure 5C:
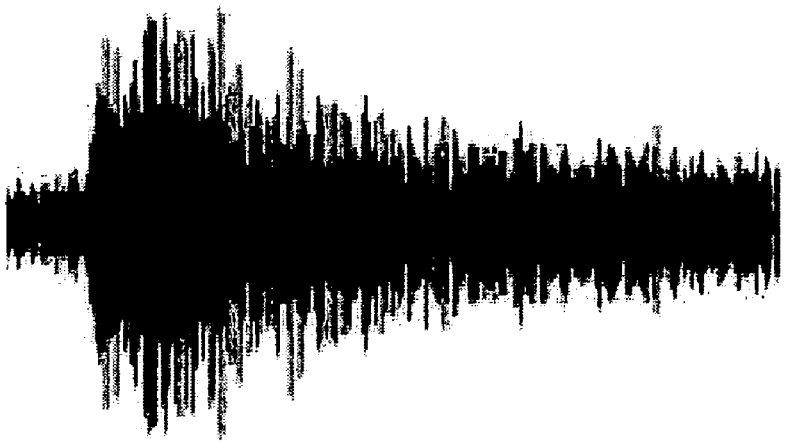

Referring to FIGS. 5*a–c*, wave forms of a strummed guitar string are generated using a standard pick (FIG. 5*a*), a five cut fan pick of the present invention (FIG. 5*b*), and a three cut fan pick of the present invention (FIG. 5*c*). These wave forms demonstrate a fuller wave form for the cut multi-contact fan picks than for the uncut single contact standard pick. In testing the picks of the present invention the musician reported that not only did the picks produce a fuller sound than the standard pick but also slipped more easily over the strings during the plucking process and more easily articulated the individual notes during a pattern picking process than was possible with a standard pick.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A multi-contact pick for strumming and articulating or picking a stringed instrument, comprising:

at least one lobe having an apex forming a single point;

at least one cut in said lobe for dividing said lobe into at least two substantially parallel juxtaposed elements defining a space or slot therebetween formed by omission of material removed to define said space or slot;

each said cut being one of on said apex and in proximity to said apex such that the number of said substantially parallel juxtaposed elements formed on said lobe is equal to one more than the number of said cuts;

said lobe having a thickness; and said substantially parallel juxtaposed elements fanning across said thickness whereby an individual string can articulate a note in accordance with the number of said juxtaposed elements.

2. The multi-contact pick of claim 1, wherein:

said cuts are one of substantially parallel and convergent toward said apex thereby maintaining said elements juxtaposed to each other along said cut;

said cuts are one of smooth and serrated;

said cuts are one of straight and curved;

said cuts are one of evenly spaced across said apex and randomly spaced across said apex;

said cuts are one of variable length and equal length; and the number of said cuts are one of laterally symmetrical across said apex and laterally asymmetrical across said apex.

3. The multi-contact pick of claim 1, wherein at least one of said cuts has an opening located at the end of said cut.

4. The multi-contact pick of claim 1, further comprising:

a pivot hole in said pick at said pick's approximate geometric center.

5. The multi-contact pick of claim 2, wherein at least one of said cuts has an opening located at the end of said cut.

6. The multi-contact pick of claim 2, further comprising a pivot hole in said pick at said pick's approximate geometric center.

7. The multi-contact pick of claim 3, further comprising a pivot hole in said pick at said pick's approximate geometric center.

8. The multi-contact pick of claim 4, wherein at least one said cut has an opening located at the end of said cut.

9. A method of converting a lobe of a single contact pick for strumming and articulating or picking a stringed instrument into a multi-contact pick formed of parallel juxtaposed elements comprising the step of:

making at least one lobe with an apex forming a single point and at least one cut in said lobe of said single contact pick at a position that is one of said apex of said lobe to form two substantially parallel juxtaposed elements;

said at least one cut being in proximity to said apex such that the number of said elements formed on said lobe is equal to one more than the number of said cuts so that an individual string can articulate a note in accordance with the number of said juxtaposed elements.

10. The method of claim 9, wherein:

said cuts are one of parallel and convergent toward said apex;

said cuts are one of smooth and serrated;

said cuts are one of straight and curved;

said cuts are one of evenly spaced across said apex and randomly spaced across said apex;

said cuts are one of variable length and equal length; and the number of said cuts are one of laterally symmetrical across said apex and laterally asymmetrical across said apex and spacing between said cuts is formed by shearing such that said spacing between cuts is substantially the same along their length.

11. The method of claim 9 further comprising the step of:

forming a hole at the end of at least one of said cuts.

12. The method of claim 10, further comprising the step of:

forming a hole at the end of at least one of said cuts.

13. The method of claim 9 further comprising the step of:

forming a pivot hole at the approximate geometric center of said pick.

14. The method of claim 10 further comprising the step of:

forming a pivot hole at the geometric center of said pick.

15. The method of claim 11 further comprising:

forming a pivot hole at the approximate geometric center of said pick.

16. The method of claim 12 comprising:

forming a pivot hole at the approximate geometric center of said pick.

17. A pick for strumming and articulating or picking a stringed instrument, comprising:

a shaped member provided with at least one lobe, each said lobe having an arcuate portion;

said lobe having at least one cut therein to form two adjacent substantially parallel juxtaposed elements extending from a position spaced from said member's geometric center and extending to an outermost edge of said lobe forming a picking point on both sides of the end of said cut and to form a space between said two substantially parallel elements having said picking point at the end thereof to permit movement of said parallel elements relative to each other and said picking points to make contact with the same string of said stringed instrument;

said cut between said two substantially parallel elements defining said space between said parallel juxtaposed elements such that the spacing is substantially uniform from said position to said outermost point;

said adjacent elements each having an outer surface at an end thereof forming a substantially continuous arcuate surface to complete said arcuate portion of said lobe with an omitted portion formed by said cut, whereby an individual string can articulate a note in accordance with the number of said juxtaposed elements.

18. The pick as claimed in claim 17, wherein said lobe is composed of three or more elements so that said elements are sufficiently close to each other such that an individual string of the stringed instrument can be articulated to a note or notes in accordance with the number of elements of the three elements and avoid contact with an adjacent string by one of said three or more elements such that the pick can both strum and pluck.

19. A pick as claimed in claim 17, wherein the outer extremity of each said element forming said picking point is defined by the outer extremity of said lobe.

20. A pick as claimed in claim 17, wherein said pick includes at least three or more elements, at least two of which have different lengths or extensions from the approximate geometric center of said pick.

* * * * *

UNITED STATES PATENT AND TRADEMARK OFFICE

CERTIFICATE OF CORRECTION

PATENT NO. : 7,060,882 B2
APPLICATION NO. : 10/819811
DATED : June 13, 2006
INVENTOR(S) : Ken Greenwald It is certified that error appears in the above-identified patent and that said Letters Patent is hereby corrected as shown below:

On the title page item (57),

In the Abstract, line 2, change “stunning” to -- strumming --.

Column 1, lines 8 and 13, each occurrence, change “pluking” to -- plucking --;

line 49, after “pick”, insert a period.

Column 2, line 23, after “thickness”, insert a comma.

Column 5, line 1, change “tired” to -- third --;

line 18, change “4H” to -- 4h--;

Signed and Sealed this

Thirteenth Day of March, 2007

JON W. DUDAS
*Director of the United States Patent and Trademark Office*